United States Patent [19]

Niino et al.

[11] Patent Number: 4,557,126

[45] Date of Patent: Dec. 10, 1985

[54] CONTROL DEVICE FOR CONTINUOUS ROLLING MACHINE

[75] Inventors: Shuhei Niino; Koichi Ishimura; Ken Okamoto; Koichi Ohba, all of Hyogo, Japan

[73] Assignee: Mitsubishi Denki Kabushiki Kaisha, Tokyo, Japan

[21] Appl. No.: 427,339

[22] Filed: Sep. 29, 1982

[30] Foreign Application Priority Data

Sep. 30, 1981 [JP] Japan ..... 56-157214
Sep. 30, 1981 [JP] Japan ..... 56-157215

[51] Int. Cl.[4] ..... B21B 37/12
[52] U.S. Cl. ..... 72/16; 72/9
[58] Field of Search ..... 72/8, 9, 11, 12, 16, 72/205, 235, 249

[56] References Cited

U.S. PATENT DOCUMENTS 3,526,113 9/1970 McNaugher ..... 72/16
3,996,776 12/1976 Bryant et al. ..... 72/9
4,323,971 4/1982 Möltner ..... 72/16
4,386,511 6/1983 Morita ..... 72/12

FOREIGN PATENT DOCUMENTS 24261 8/1975 Japan ..... 72/16
6701 1/1981 Japan ..... 72/235
117815 9/1981 Japan ..... 72/9

*Primary Examiner*—Lowell A. Larson
*Assistant Examiner*—Jorji M. Griffin
*Attorney, Agent, or Firm*—Sughrue, Mion, Zinn, Macpeak & Seas

[57] ABSTRACT

A control device for a rolling machine includes a forecaster for predicting a change in the lateral dimension of a rolled material at the exit of a downstream mill stand based on dimensional variations, and a mechanism by which the tension on the material between two mill stands is altered in accordance with the forecast value, to control the lateral dimension of rolled material exiting the last of a series of mill stands.

1 Claim, 6 Drawing Figures

CONTROL DEVICE FOR CONTINUOUS ROLLING MACHINE

BACKGROUND OF THE INVENTION

This invention concerns the dimensional control of a material rolled in a continuous rolling machine having a grooved roll, for example, a bar steel mill or a wire mill.

An example of the structure of a continuous rolling machine of this type is shown in FIG. 1.

FIG. 1 shows a continuous rolling machine comprising i mill stands, wherein a first mill stand 1, a second mill stand 2, on i-1th mill stand 3, and ith mill stand 4, and a material 5 to be rolled are shown.

The successive rolling mill in FIG. 1 is a so-called VH type rolling mill. That is, horizontal mill stands (odd numbered stands in FIG. 1) and vertical mill stands (even numbered stands in FIG. 1) are arranged alternately.

For instance, the i-1th mill stand 3 is a vertical mill stand which performing rolling in the direction X. In FIG. 1, reference character bi−1 represents the lateral dimension and reference character hi−1 represents the vertical dimension at the exit of the i-1th mill stand 3. On the other hand, ith mill stand 4 is a horizontal mill stand which performs rolling in the direction Y. Reference character bi represents the lateral dimension and reference character hi represents the vertical dimension at the exit of the ith mill stand 4.

Conventional continuous rolling machines such as a bar steel mill and a wire mill employ a loop control and a tension control mechanism as a means for reducing the tension between the mill stands to zero. However, dynamic control has yet to be provided in the art because of the following reasons.

(1) There have been no severe requirements on the dimensions of the products.

(2) Mill elongation due to a change in the load during rolling is small (which makes the dimensional accuracy of the products better since the effect of transferring the change at the inlet of the rolling material to the exit is decreased).

Accordingly, since no particular control has been exercised, in the conventional control system, over the change of dimensions relative to the change in the temperature of rolling material or the like, dimensional accuracy has been worsened.

SUMMARY OF THE INVENTION

This invention has been made in view of the foregoing drawbacks; and it is an object thereof to control the tension of the rolling material between optional stands in order to eliminate changes in the lateral dimension, to thereby improve the dimensional accuracy of the rolling material.

It is a further object to perform highly accurate dimensional control, wherein a change in the lateral dimension of a rolling material at the exit of an ith mill stand is forecast based on a change in the dimension of the material at the exit of another mill stand, and wherein the tension of the material between an i-1th mill stand and the ith mill stand is controlled so that the forecast change in the lateral dimension is reduced to zero while, at the same time, the tension of the material between the i-1th mill stand and the ith mill stand is controlled so that a difference between an actually measured lateral dimension of the material at the exit of the ith mill stand and a reference lateral dimension is reduced to zero; and wherein a control gain coefficient for control relevant to said forecast value is adjusted so as to eliminate the change in the lateral dimension of the material at the exit of the ith mill stand.

DETAILED DESCRIPTION OF THE PREFERRED EMBODIMENTS

Figure 1:
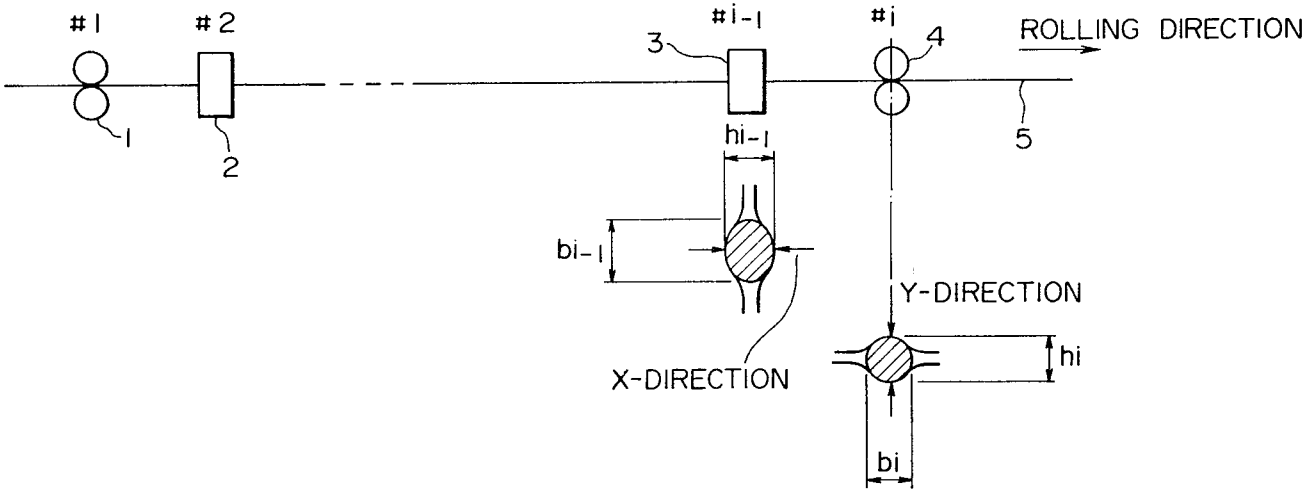
FIG. 1 is a schematic view of one example of the structure of a continuous rolling machine having a grooved roll.
Figure 2:
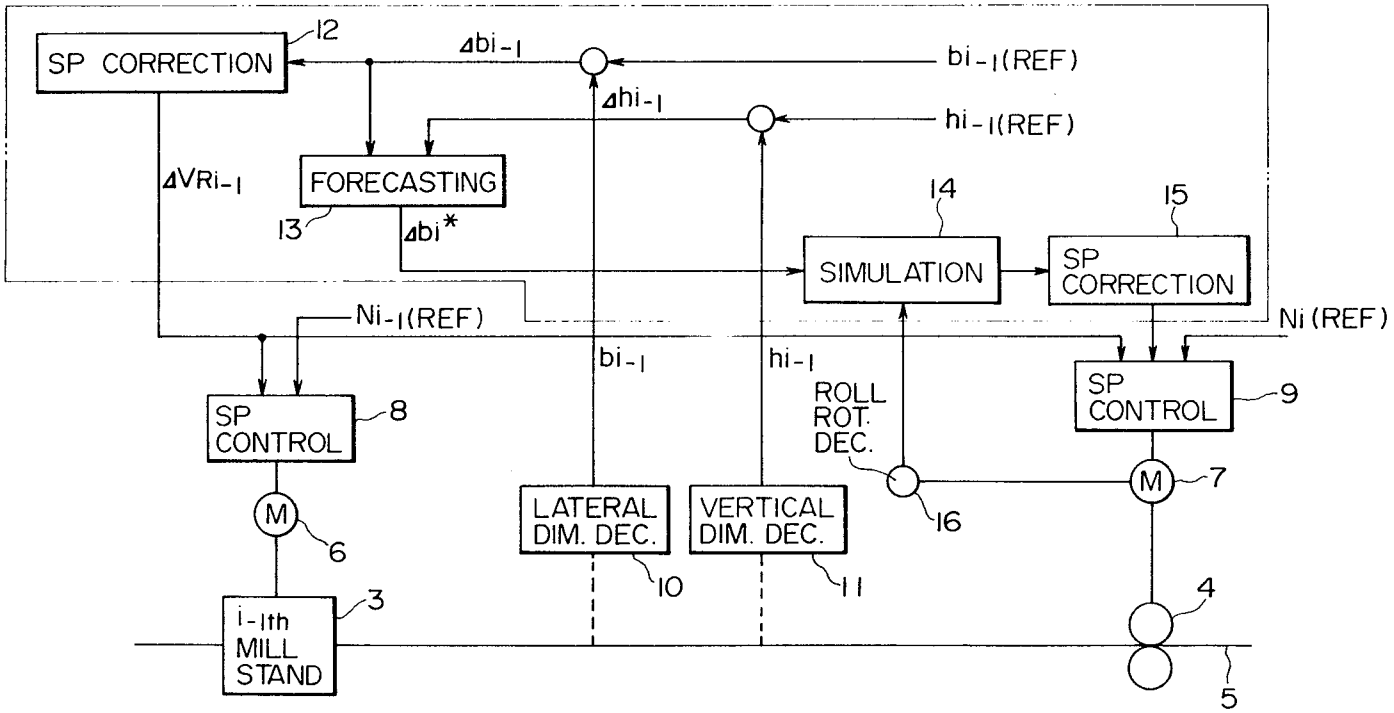
FIG. 2 is a block diagram showing a dimension control device of one embodiment according to this invention.

This invention will now be described by way of its preferred embodiments, referring to the accompanying drawings. In FIG. 2, there are shown in i-1th mill stand 3, and ith mill stand 4, a material 5 to be rolled, stand driving motors 6, 7, speed control devices 8, 9 for controlling the speed of the stand driving motors, a lateral dimension detection device 10 for detecting the lateral dimension of the material 5 at the exit of the i-1th mill stand 3, a vertical dimension detection device 11 for detecting the vertical dimension of the material 5 at the exit of the i-1th mill stand 3, and a speed correction circuit 12 that is supplied with a difference signal Δbi−1 between a detected value bi−1 from the lateral dimension detection device 10 and a reference value lateral dimension bi−1 (REF), at the exit of the i-1th mill stand 3, and outputs a speed correction signal ΔVRi−1 to the speed control device 8 so as to reduce Δbi−1 to zero. A forecasting device 13 is supplied with the change Δbi−1 in the lateral dimension of the material and the change Δhi−1 in the vertical dimension at the exit of the i-1th mill stand 3 and forecasts a change γbi* in the lateral dimension of the material at the exit of the ith mill stand 4 resulting from the changes mentioned above, and a simulation device 14 simulates the time required for the rolling material 5 to transfer from the dimension detectors 10, 11 to the ith mill stand 4. A speed correction circuit 15 generates a speed correction signal for the speed control device 9 for the ith mill stand 4 in accordance with the forecast value Δbi* from the forecasting device 13 obtained by way of said simulation device 14. A roll rotation detector 16 is connected to the stand driving motor 7.

Figure 3A:
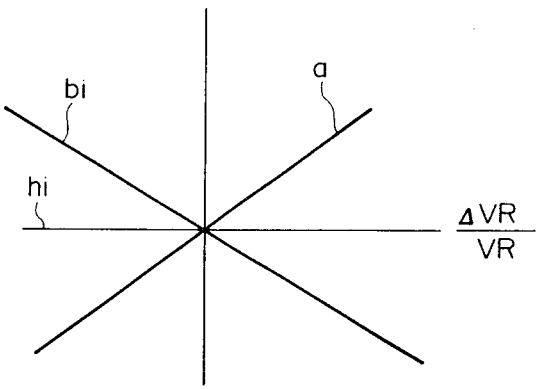
FIGS. 3*a* and 3*b* are characteristic diagrams showing the characteristics of the rolling mill.
Figure 3B:
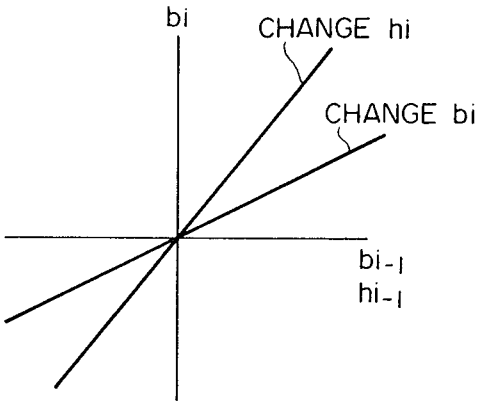

The operation of the device will now be explained. FIG. 3(*a*) shows the change in the tension a of the rolling material between the i-1th mill stand and the ith mill stand, as well as the change in the vertical dimension hi and the lateral dimension bi at the exit of the ith mill stand 4 in the case where the speed (ΔVR/VR) of the ith mill stand 4 is changed. As can be seen from FIG. 3(*a*), a change in the speed of the ith mill stand 4 results in no substantial change in the vertical dimension hi and only the lateral dimension bi is changed. That is, the lateral dimension of the material at the exit of the mill stand can be controlled by a change in the tension.

FIG. 3(*b*) shows the change in the lateral dimension bi of the material at the exit of the ith mill stand resulting from a change hi−1 in the vertical dimension and a change bi−1 in the lateral dimension of the material at the inlet of the ith mill stand. As can be seen from FIG. 3(*b*), the lateral dimension bi of the material at the exit of the ith mill is changed by either of the changes in the lateral dimension and the vertical dimension at the inlet of the ith mill stand. Thus, according to this invention, noting the characteristics shown in FIGS. 3(*a*) and (*b*), any difference in the lateral dimension at the inlet of the ith mill stand is detected by the lateral dimension detection device 10 disposed between the i-1th mill stand and the ith mill stand, and the speed of the i-1th mill stand 3 is corrected depending on this difference to thereby control the tension after the i-1th mill stand, and thus zero the change in the lateral dimension of the material at the inlet of the ith mill stand 4.

Further, any difference in the vertical dimension of the material at the inlet of the ith mill stand 4 is detected by the vertical dimension detection device 11 disposed between the i-1th and the ith mill stands, and a change in the lateral dimension of the material at the exit of the ith mill stand 4 is forecast based on the difference in the vertical dimension and the difference in the lateral dimension, and the speed of the ith mill stand 4 is corrected so as to reduce the forecast change to zero, to thereby control the tension.

The control method according to this invention will now be explained more specifically.

Explanation will be made at first to a method for suppressing dimensional changes at the exit of the ith mill stand 4 resulting from the changes in the dimension of the material 5 at the inlet of the ith mill stand 4. A difference signal Δbi−1 between the lateral dimension bi−1 of the material at the exit of the i-1th mill stand 3 detected by the lateral dimension detection device 10 and a reference lateral dimension bi−1 (REF) at the exit of the i-1th mill stand is inputted to the forecasting device 13. Likewise, a difference signal Δhi−1 between the vertical dimension hi−1 of the material at the exit of the i-1th mill stand 3 detected by the vertical dimension detection device 11 and a reference vertical dimension hi−1 (REF) at the exit of the i-1th mill stand is also inputted to the forecasting device 13. The forecasting device 13 forecasts the change Δbi* in the lateral dimension of the material at the exit of the ith mill stand 4 based on the inputted changes Δbi−1 in the lateral dimension and Δhi−1 in the vertical dimension in accordance with equation (1):

$$\Delta bi = \frac{\partial bi}{\partial bi-1} \cdot \Delta bi-1 + \frac{\partial bi}{\partial hi-1} \cdot \Delta hi-1 \qquad (1)$$

where ∂bi/∂bi−1 represents an effect coefficient of the change in the lateral dimension at the exit of the i-1th mill stand relative to the change in the lateral dimension at the exit of the ith mill stand and ∂bi/∂hi−1 represents an effect coefficient of the change in the vertical dimension at the exit of the i-1th mill stand relative to the change in the vertical dimension at the exit of the ith mill stand.

The change Δbi* in the lateral dimension forecast by the forecasting device 13 is inputted by way of the simulation device 14 to the speed correction circuit 15. Then, a speed correction signal is supplied to the speed control device 9 for the ith mill stand so as to reduce the change bi* to zero. Accordingly, the speed of the driving motor 7 for the ith mill stand is changed by the speed control device 9, whereby the tension of the material between the i-1th mill stand and the ith mill stand is controlled so that the lateral dimension of the material 5 at the exit of the ith mill stand 4 agrees with the reference lateral dimension at the exit of the ith mill stand. The simulation device 14 receives the output from rotation detector 16 and simulates the time required for the material 5 to be transported from the dimension detection devices 10, 11 to the ith mill stand.

Incidentally, in the control method described above, since only the tension between the ith mill stand and the i-1th mill stand is controlled if the dimensional change at the exit of the i-1th mill stand increases, the tension between the i-1th mill stand the i-th mill stand could be caused to be increased excessively, thereby leading to a danger of twisting or buckling.

In order to avoid such risk, according to this invention, the change in the lateral dimension at the exit of the i-1th mill stand 3 is suppressed by also applying speed control to the driving motor 8 for the i-1th mill stand, to change the tension between the i-2th mill stand and the i-1th mill stand, whereby the above-mentioned danger can be eliminated and the dimension of the material at the exit of the ith mill stand 4 can be rendered more accurate.

Specifically, the change Δbi−1 in the lateral dimension of the material at the exit of the i-1th mill stand 3 is supplied to the speed correction circuit 12. The speed correction circuit 12 outputs a speed correction signal ΔVRi−1 to the speed control device 8 for the i-1th mill stand so as to reduce the inputted change Δbi−1 in the lateral dimension to zero. The speed control device 8 corrects the speed of the driving motor 6 using the speed correction signal to thereby control the tension of the material between the i-2th mill stand and the i-1th mill stand, so that the lateral dimension of the material at the exit of the i-1th mill stand 3 may agree with the reference lateral dimension bi−1 (REF).

Speed correction signal from the speed correction circuit 12 is also inputted to the speed control device 9, so that speed control for the i-1th mill stand may provide no effect on the tension between the i-1th mill stand and the ith mill stand.

In the embodiment described above, although the lateral dimension detection device 10 and the vertical dimension detection device 11 are disposed at the exit of the i-1th mill stand 3 and the change in the lateral dimension at the exit of the ith mill stand is forecast based on the detection values, forecasting may be carried out based in the detection value from either one of the dimension detection devices. Further, forecasting is also possible by disposing the detection device between mill stands upstream of the i-th mill stand. Furthermore, in the embodiment described above, although a system applying speed correction to the downstream stand of the two stands is used to change the tension between the stands, the same effect can also be obtained by applying speed correction to the upstream stand. Furthermore, although a simulation device 14 is used in this embodiment, such a device may be omitted in a case where the distance between the dimension detection devices 10, 11 and the ith mill stand is short, or where the rolling speed is high.

Figure 4:
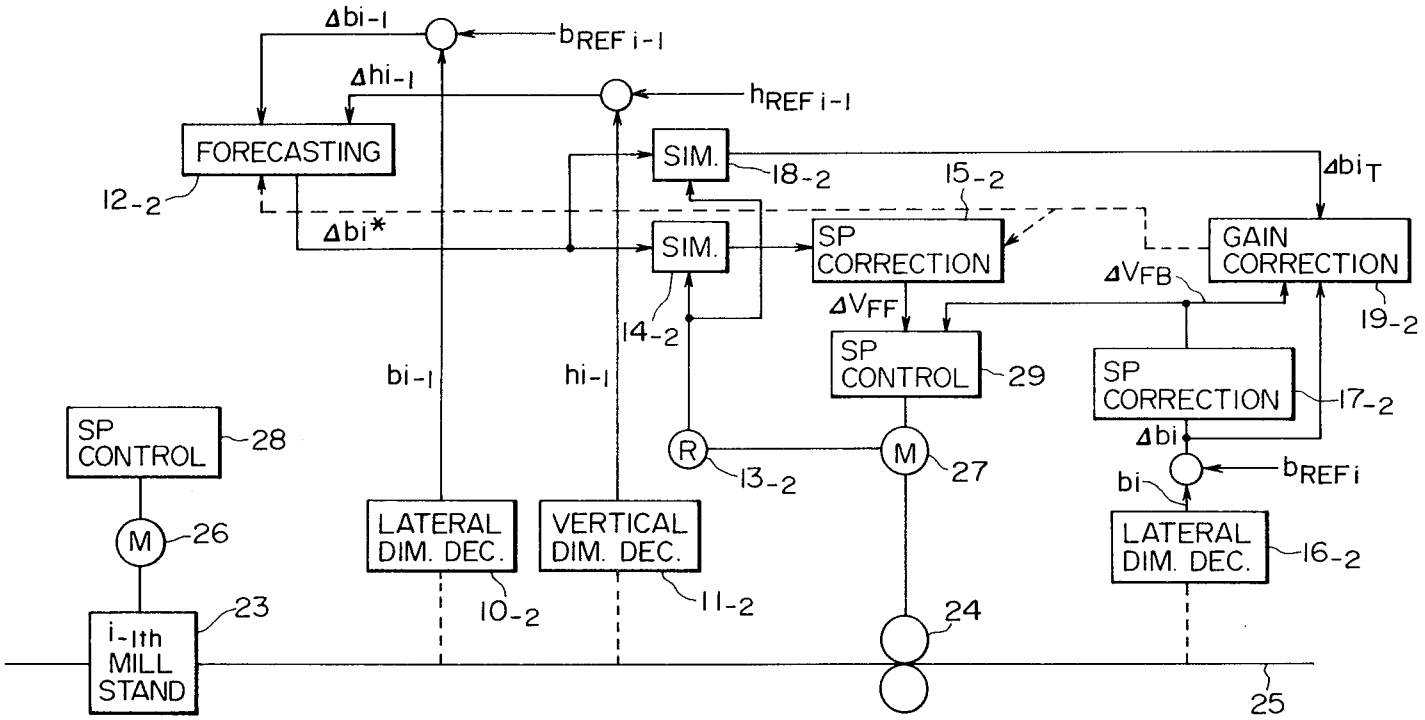
FIG. 4 is a block diagram of a control device according to another embodiment of the invention.
Figure 5:
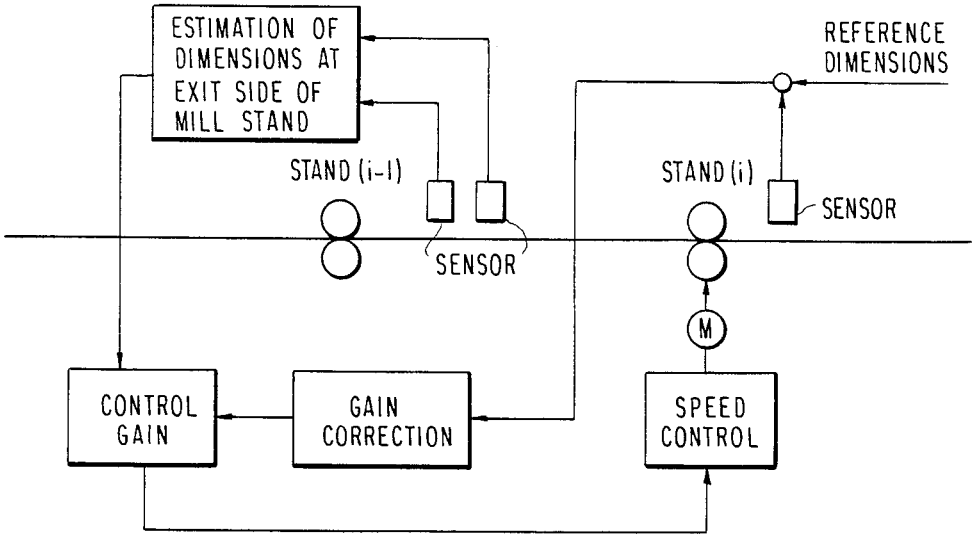
FIG. 5 is a functional block diagram corresponding to FIG. 4.

A second embodiment of the invention will now be explained referring to the FIG. 4. In FIG. 4, there are shown an i-1th mill stand 23, an ith mill stand 24, material 25 to be rolled, stand drive motors 26, 27, speed control devices 28, 29 for speed control of the stand drive motors, a lateral dimension detector 10-2 for the detection of the lateral dimension of the rolling material at the exit of the i-1th mill stand, and a vertical dimension detector 11-2 for the detection of the vertical dimension of the rolling material at the exit of the i-1th mil stand. Each of the differences Δbi−1, Δhi−1 in lateral dimension bi−1 and vertical dimension hi−1 detected by the dimension detectors 10-2, 11-2 and their reference values bREFi−1, hREFi−1, respectively are inputted to forecasting device 12-2.

A forecast value Δbi* for the change in the lateral dimension at the exit of the ith mill stand is calculated in the forecasting device based on the lateral dimension difference Δbi−1 and the vertical dimension difference Δhi−1. In FIG. 4, also shown are a roll rotation detector 13-2 connected to the ith mill stand 24, a simulation device 14-2 which simulates the time required for the material to be transported from the positions of the dimension detectors 10-2, 11-2 to the ith mill stand, a speed correction device 15-2 which generates a speed correction signal for the speed control device 29 in accordance with the forecast value Δbi* from the forecasting device 12-2 input by way of the simulation device 14-2, and a lateral dimension detector 16-2 for detecting the lateral dimension of the material at the exit of the ith mill stand 24. The difference Δbi between the lateral dimension bi detected by the lateral dimension detector 16-2 and a reference value bREFi thereof is input to a speed correction device 17-2, which constitutes a speed correction means for the ith mill stand to control the speed of the same. Further, there is disposed a simulation device 18-2 that simulates the time required for the rolling material to be transported from the positions of the dimension detectors 10-2, 11-2 to the exit of the ith mill stand, and a gain correction device 19-2 for correcting the control gain of the speed correction device 15-2.

The operation of this embodiment will now be explained. According to this embodiment, again taking note of the characteristics shown in FIGS. 3(*a*) and (*b*), the difference in the lateral dimension at the inlet of the ith mill stand is detected by the lateral dimension detector disposed between the stands. Further, a difference in the vertical dimension at the inlet of the ith mill stand is detected by the vertical dimension detector disposed between the stands, and a change in the lateral dimension at the exit of the ith mill stand produced based on the difference in the vertical dimension and the difference in the lateral dimension is forecast, and the speed of the ith mill stand is corrected by an amount $\Delta V_{FF}$ so that the forecast change is reduced to zero, to thereby control the tension in the rolling material.

Further, the difference in the lateral dimension of the rolling material at the exit of the ith mill stand is detected by the lateral dimension detector 16-2 disposed at the exit of the ith mill stand and the speed for the ith mill stand is corrected by an amount $\Delta V_{FB}$ so that the detected difference is reduced to zero.

Speed correction for the ith mill stand 24 using the dimension detection devices 10-2, 11-2 at the inlet of the ith mill stand will be denoted as feed forward control and speed correction for the ith mill stand 4 using the lateral dimension detection device 16-2 at the exit of the ith mill stand will be termed feedback control.

Further, in order to optionally adjust the control gain of the feed forward control, an optimum gain is calculated based on the forecast change Δbi* in the lateral dimension at the exit of the ith mill stand 24, the actually measured change Δbi in the lateral dimension at the exit of the ith mill stand and the control output $\Delta V_{FB}$ of the feedback control, whereby the control gain for the feed forward control is modified in the optimum value.

The control system according to this embodiment will now be described in more detail. It is assumed here that the lateral dimension of the material to be measured by the lateral dimension detector 10-2 is bi−1, the reference lateral dimension is bREFi−1 and the change in the lateral dimension is Δbi−1 (=bi−1−bREFi−1). On the other hand, the vertical dimension of the rolling material actually measured by the vertical dimension detector 11-2 is taken as hi−1, the reference vertical dimension as hREFi−1 and the change in the vertical dimension as Δhi−1 (=hi−1−hREF−1). When the value Δhi−1 and the change Δbi−1 in the lateral dimension are input, the forecasting device 13-2 forecasts the change Δbi* in the lateral dimension at the exit of the mill stand 24 based on the following equation (2):

$$\Delta bi^* = \frac{\partial bi}{\partial bi-1} \cdot \Delta bi + \frac{\partial bi}{\partial hi-1} \cdot \Delta hi - 1 \qquad (2)$$

where:

∂bi/∂bi−1: an effect coefficient of the change in the lateral dimension at the exit of the i-th mill stand relative to the change in the lateral dimension at the exit of the i-1th mill stand, ∂bi/∂hi−1: an effect coefficient of the change in the vertical dimension at the exit of the i-1th mill stand relative to the change in the vertical dimension at the exit of the ith mill stand.

Since there are certain distances between the dimension detection devices 10-2, 11-2 and the ith mill stand 24, it takes a certain time for the material that has passed just below the dimension detectors to arrive just below the ith mill stand. The time required for this transportation is simulated by the simulation device 14-2 which receives the output from the roll rotation detector 13-2 connected to the ith mill stand 24.

That is, the output from the forecasting device 12-2 by way of the simulation device 14-2 gives a forecast value of the change in the lateral dimension at the exit just below the ith mill stand. Accordingly, the speed correction device 15-2 for the ith mill stand calculates such a speed correction signal $\Delta V_{FF}$ as will reduce the forecast change Δbi* in the lateral dimension to zero based on this output and delivers the calculation result to the speed control device 29. The speed control device 29 corrects the speed of the drive motor 27 in accordance with the speed correction signal generated from the speed correction device 15-2 to thereby control the tension in the material after the ith mill stand. Feed forward control is thus performed.

Then, a difference signal Δbi(=bi−bREFi) between the lateral dimension bi of the material actually measured by the lateral dimension detector 16-2 and the reference lateral dimension bREFi at the exit of the ith mill stand is inputted to the speed correction device 17-2. The speed correction device 17-2 then supplies a speed correction signal $\Delta V_{FB}$, such as to reduce the inputted change Δbi in the lateral dimension to zero, to the speed control device 29 for the ith mill stand to thereby correct the speed of the drive motor 27 that drives the ith mill stand. As the result, the tension between the i-1th mill stand and the ith mill stand is changed to control the lateral dimension bi of the material at the exit of the ith mill stand so as to agree with the reference lateral dimension bREFi. Feedback control is thus performed.

Since the dimension detectors 10-2, 11-2 are disposed at the inlet of the ith mill stand in the feed forward control as described above, control is possible at a rapid response with no time lag in forecasting the lateral dimension. However, since the lateral dimension is predicted in a forecasting manner, the accuracy is relatively poor.

On the contrary, with the feedback control, since the lateral dimension detector 16-2 is disposed at the exit of the ith mill stand, there is a time lag during which the rolling material 5 is transported from just below the ith mill stand to the lateral dimension detector 16, and only a slow control response can be obtained. However, since the lateral dimension at the exit of the ith mill stand is actually measured by the lateral dimension detector 16-2, high accuracy can be obtained.

In view of the above, the simultation device 18-2 and the gain correction device 19-2 are provided in order to offset the disadvantages of each of the control systems, as explained below.

The calculation equation in the speed correction device 15 is as follows:

$$\Delta V_{FF} = G_1 = \Delta bi^* \tag{3}$$

where $G_1$ represents the control gain.

The time required for transporting the rolling material from the dimension detectors 10-2, 11-2, to the lateral dimension detector 16-2 is simulated by the simulation device 18-2 and the forecast difference in the lateral dimension of the material 5 arriving at the lateral dimension detector 16-2 is outputted as ΔbiT. If the forecast value Δbi* from the forecasting device 12-2 and the control gain $G_1$ of the speed correction device 15-2 are exact, the difference Δbi in the lateral dimension at the exit of the ith mill stand may be reduced to zero. However, if there is an error in either one, the difference bi is not reduced to zero.

In order to correct this, a new control gain $G_1$ (NEW) for the speed correction device 15-2 is calculated and altered according to equation (4):

$$G_1\,(\text{NEW}) = \frac{\Delta biT}{\Delta biT - \Delta bi} \times G_1 \tag{4}$$

Since there may be a risk of introducing hunting due to errors in the alteration of the control gain, it may be altered after exponential smoothing.

Then, if a feedback correction signal $\Delta V_{FB}$ is present, the difference in the lateral dimension is corrected using the correction speed $\Delta V_{FB}$. Generally, since the difference between the speed change and the lateral dimension shown in FIG. 3(*a*) can easily be judged, the correction is carried out using this value. If $\Delta V_{FB}$ is present, the calculation is carried out according to the following equation (5):

$$G_1\,(\text{NEW}) = \frac{\Delta biT}{\Delta biT - \left(\Delta bi - \frac{\partial bi}{\partial Vi} \cdot \Delta V_{FB}\right)} \times G_1 \tag{5}$$

where ∂bi/∂Vi represents an effect coefficient of the change in the speed of the ith mill stand relative to the change in the lateral dimension at the exit of the ith mill stand.

The gain alteration may be performed after exponential smoothing of this case also. Since the gain $G_1$ for the feed foward control is optimally adjusted by the gain correction device 19-2; accuracy in the feed forward control can be improved.

In the above embodiment, although explanation has been made with respect to a system where the control gain G of the speed correction device 15-2 is corrected by a gain control device 19-2, the same effect can also be obtained by correcting the coefficients $$\frac{\partial bi}{\partial bi - 1}, \frac{\partial bi}{\partial hi - 1}$$

of equation (2) in the forecasting device 12-2 instead of altering the control gain G, since the forecasting device 12-2 and the speed correction device 15-2 are disposed in series as shown in FIG. 4.

Further, in the above embodiment, although the lateral dimension detector 10-2 and the vertical dimension detector 11-2 are disposed between the i-1th mill stand and the ith mill stand and the change in the lateral dimension at the exit of the ith mill stand is forecast based on the detection values, forecasting can be performed using only one of the detectors or by disposing them at positions other than between the i-1th mill stand and the ith mill stand.

Further, in order to change the tension between the stands, a system of correcting the speed of the downstream stand is shown in the above embodiment, although the same effect can also be obtained by correcting the speed of the upstream stand.

Further, although the use of simulation devices 14-2, 18-2 is shown, these may be omitted in the case where the distance between the dimension detector and the ith mill stand is short or where the rolling speed is high.

As described above, according to a first embodiment of this invention, since the dimension of a material between stands is detected, a change in the lateral dimension at the exit of an ith mill stand can be forecast based on the detected value, and since the tension of the rolling material between the i-1th mill stand and the ith mill stand is controlled, dimentional control with high accuracy is possible. Further, since a lateral change in the rolling material at the exit of the i-1th mill stand is eliminated by the control of the tension in the material between the i-2th mill stand and the i-1th mill stand, dimensional control at high accuracy can be attained with no danger of twisting or buckling between the i-1th mill stand and the ith mill stand.

As described above, according to this invention, dimensional control is possible with good responsiveness and with high accuracy since a change in the lateral dimension of the rolling material at the exit of the ith mill stand is forecast based on the change in the dimension of the material at the exit of another mill stand, and the tension of the material between the i-1th mill stand and the ith mill stand is controlled so that the forecast change in the lateral dimension is reduced to zero, (while the tension of the material is reduced to zero,) while the tension of the material between the i-1th mill stand and the ith mill stand is likewise controlled so that a difference between the actually measured lateral dimension of the material and a reference lateral dimension (of the material and a reference lateral dimension) at the exit of the ith mill stand is reduced to zero, and the control gain or a coefficient used in the control relevant to the forecast value is adjusted so as to eliminate any change in the lateral dimension at the exit of the ith mill stand.

What is claimed is:

1. A control device for a continuous rolling machine, comprising; dimension detection means for detecting the dimension of a material at the exit of a mill stand, forecasting means receiving a difference between a dimension of the material as detected by said dimension detection means and a reference material dimension at the exit of said mill stand for forecasting a change in the lateral dimension of the material at the exit of an ith mill stand situated downstream of said mill stand, first control means for controlling the tension on the material between an i-1th mill stand and the ith mill stand so that said change in the lateral dimension forecast by said forecasting means is reduced to zero, lateral dimension detection means disposed at the exit of the ith mill stand for detecting the actual lateral dimension bi of the material at the exit of said ith mill stand, second control means receiving the difference between the actual lateral dimension as detected by said lateral dimension detection means and a reference lateral dimension bREF at the exit of said ith mill stand for further controlling the tension on the material between the ith and i-1th mill stands so that said difference is reduced by zero; said first control means comprising speed correction means (15-2) responsive to said forecast change for producing a feed-forward speed control signal ($\Delta V_{FF}$); said second control means comprising additional speed correction means (17-2) responsive to said difference between said actual lateral dimension and said reference lateral dimension to produce a feed-back speed control signal ($\Delta V_{FB}$); and speed control means (29), responsive to said feed-forward signal and to said feed-back signal, for controlling the speed of said ith mill stand and controlling said tension to reduce to zero both said forecast change and said difference between said actual lateral dimension and said reference lateral dimension.

* * * * *